US007156183B2

(12) United States Patent
Williams

(10) Patent No.: US 7,156,183 B2
(45) Date of Patent: Jan. 2, 2007

(54) ELECTRIC HYDRAULIC POWER UNIT AND METHOD OF USING SAME

(75) Inventor: Michael R. Williams, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 97 days.

(21) Appl. No.: 10/990,736

(22) Filed: Nov. 17, 2004

(65) Prior Publication Data

US 2006/0102357 A1 May 18, 2006

(51) Int. Cl.
*E21B 33/035* (2006.01)
*F01B 31/00* (2006.01)

(52) U.S. Cl. ..... 166/386; 92/131; 92/130 D

(58) Field of Classification Search ..... 166/386, 166/66.6, 332.1, 375, 86.2, 87.1, 320, 381, 166/373, 86.1; 92/131, 130 D; 417/415
See application file for complete search history.

(56) References Cited

U.S. PATENT DOCUMENTS

| | | | | |
|---|---|---|---|---|
| 2,600,750 | A * | 6/1952 | Gaudet et al. | 417/549 |
| 3,677,001 | A | 7/1972 | Childers et al. | 60/51 |
| 3,743,013 | A | 7/1973 | Harbonn | 166/0.5 |
| 3,886,746 | A | 6/1975 | Farr | 60/547 |
| 4,324,101 | A | 4/1982 | Farr | 60/562 |
| 5,238,070 | A * | 8/1993 | Schultz et al. | 166/386 |
| 5,813,230 | A | 9/1998 | Hartl et al. | 60/591 |
| 6,276,137 | B1 | 8/2001 | Kottmyer et al. | 60/591 |
| 6,702,025 | B1 | 3/2004 | Meaders | 166/335 |
| 6,775,979 | B1 | 8/2004 | Drott et al. | 60/588 |
| 2002/0011580 | A1 * | 1/2002 | Johansen et al. | 251/129.1 |
| 2003/0037544 | A1 | 2/2003 | Armstrong | 60/413 |
| 2005/0178557 | A1 * | 8/2005 | Johansen et al. | 166/368 |
| 2005/0178560 | A1 * | 8/2005 | Johansen et al. | 166/374 |

FOREIGN PATENT DOCUMENTS

| | | | |
|---|---|---|---|
| EP | 0 916 853 | A3 | 3/2000 |
| EP | 0 896 125 | A3 | 4/2000 |
| EP | 0 962 622 | A3 | 6/2000 |
| GB | 2 120 333 | A | 11/1983 |
| SU | 1472658 | A1 | 4/1989 |

* cited by examiner

*Primary Examiner*—William Neuder
*Assistant Examiner*—Nicole A Coy
(74) *Attorney, Agent, or Firm*—Williams, Morgan & Amerson, P.C.

(57) ABSTRACT

An apparatus includes a housing defining a chamber therein and defining an inlet port and an outlet port and a movable pressure barrier, disposed in the chamber, separating the chamber into first and second portions, the inlet port and the outlet port being in fluid communication with the first portion of the chamber. The apparatus further includes a drive spring disposed in the second portion of the chamber for urging the movable pressure barrier in a pumping direction when in a compressed state, electric means for compressing the drive spring, and a return spring disposed in the first portion of the chamber for urging the movable pressure barrier in a recharging direction when the drive spring is in an uncompressed state.

29 Claims, 6 Drawing Sheets

103
102
144
100
138
142
146
120
140
108
122
125
104
152
112
126
124
116
159
110
158
122
118
128
160
154
106
130
156
114
148
150

103
102
144
100
138
142
146
120
140
108
122
125
106
104
126
152
112
124
116
159
158
110
122
118
154
128
160
130
156
114
148
162
150

ELECTRIC HYDRAULIC POWER UNIT AND METHOD OF USING SAME

BACKGROUND OF THE INVENTION

1. Field of the Invention

This invention relates to a hydraulic power unit (HPU). More specifically, the present invention relates to an electrically powered HPU and a method of using same. In one illustrative embodiment, the present invention is directed to a subsea HPU.

2. Description of the Related Art

A typical subsea wellhead control system, shown schematically in FIG. 1, includes a subsea tree 40 and tubing hanger 50. A high-pressure hydraulic line 26 runs downhole to a surface-controlled subsea safety valve (SCSSV) actuator 46, which actuates an SCSSV. A subsea control module (SCM) 10 is disposed on or near the tree 40. The SCM includes an electrical controller 12, which communicates with a rig or vessel at the surface 32 via electrical umbilical 30.

Through control line 22, the controller 12 controls a solenoid valve 20, which in turn controls the flow of high-pressure hydraulic fluid from hydraulic umbilical 28 to hydraulic line 26, and thus to SCSSV actuator 46. When controller 12 energizes solenoid valve 20, high-pressure hydraulic fluid from umbilical 28 flows through valve 20 and line 26 to energize SCSSV actuator 46 and open the SCSSV. The required pressure for the high-pressure system depends on a number of factors, and can range from 5000 to 17,500 psi. In order to operate the SCSSV, the hydraulic fluid pressure must be sufficient to overcome the working pressure of the well, plus the hydrostatic head pressure.

When solenoid valve 20 is de-energized, either intentionally or due to a system failure, a spring in valve 20 returns the valve to a standby position, wherein line 26 no longer communicates with umbilical 28, and is instead vented to the sea through vent line 24. The SCSSV actuator is de-energized, and the SCSSV is allowed to close. Note that, generally, SCSSVs are spring loaded to the closed position. Typically, solenoid valves such as 20 are relatively large, complex, and expensive devices. Each such valve may include ten or more extremely small-bore pilot valves, which are easily damaged or clogged with debris.

Through control line 23, the controller 12 controls a number of solenoid valves such as 14, which in turn controls the flow of low-pressure hydraulic fluid from hydraulic umbilical 16 to hydraulic line 44, and thus to actuator 42. Typically the low-pressure system will operate at around 3000 psi. Actuator 42 may control any of a number of hydraulic functions on the tree or well, including operation of the production flow valves. A typical SCM may include 48 or more low-pressure solenoid valves such as 14.

For economic and technical reasons well known in the industry, in subsea wells it is desirable to eliminate the need for hydraulic umbilicals extending from the surface to the well. Referring to FIG. 2, one known method for accomplishing this is to provide a source of pressurized hydraulic fluid locally at the well. Such a system includes an SCM essentially similar to that shown in FIG. 1. However, in the system of FIG. 2, high and low-pressure hydraulic fluid is provided by independent subsea-deployed pumping systems.

A storage reservoir 64 is provided at or near the tree, and is maintained at ambient hydrostatic pressure via vent 66. Low-pressure hydraulic fluid is provided to solenoid valves 14 through line 60 from a low-pressure accumulator 74, which is charged by pump 70 using fluid from storage reservoir 64. Pump 70 is driven by electric motor 72, which may be controlled and powered from the surface or locally by a local controller and batteries. The pressure in line 60 may be monitored by a pressure transducer 76 and fed back to the motor controller. Hydraulic fluid, which is vented from actuators such as 42, is returned to storage reservoir 64 via line 62. High-pressure hydraulic fluid is provided to solenoid valve 20 through line 68 from a high-pressure accumulator 84, which is charged by pump 80 using fluid from storage reservoir 64. Pump 80 is driven by electric motor 82, which may be controlled and powered from the surface or locally by a local controller and batteries. The pressure in line 68 may be monitored by a pressure transducer 86, and the pressure information fed back to the motor controller.

Subsea systems have also been developed which replace all the low-pressure hydraulic actuators 42 with electrically powered actuators, thus eliminating the entire low-pressure hydraulic system. One possible solution for eliminating the high pressure hydraulic system is to omit the SCSSV from the system, thus eliminating the need for high-pressure hydraulic power. However, SCSSV's are required equipment in many locations, and thus cannot be omitted from all systems. Also, because of the harsh downhole environment, it is not practical to replace the hydraulic SCSSV actuators with less robust electric actuators. Although the high-pressure hydraulic system remains necessary in many systems, it would still be desirable to reduce the number and/or complexity of the components which make up the high-pressure system.

The present invention is directed to overcoming, or at least reducing, the effects of one or more of the problems set forth above.

SUMMARY OF THE INVENTION

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

The present invention is directed to an electric-hydraulic power unit. In one aspect of the present invention, the apparatus includes a housing defining a chamber and a movable pressure barrier, disposed in the chamber, separating the chamber into first and second portions. The apparatus further includes a drive spring disposed in the second portion of the chamber for urging the movable pressure barrier in a pumping direction when in a compressed state and a return spring disposed in the first portion of the chamber for urging the movable pressure barrier in a recharging direction when the drive spring is in an uncompressed state.

In another aspect of the present invention, an apparatus includes a housing defining a chamber therein and defining an inlet port and an outlet port and a movable pressure barrier, disposed in the chamber, separating the chamber into first and second portions, the inlet port and the outlet port being in fluid communication with the first portion of the chamber. The apparatus further includes a drive spring disposed in the second portion of the chamber for urging the movable pressure barrier in a pumping direction when in a compressed state, electric means for compressing the drive spring, and a return spring disposed in the first portion of the chamber for urging the movable pressure barrier in a recharging direction when the drive spring is in an uncompressed state. The apparatus also includes a reservoir containing hydraulic fluid in fluid communication with the inlet port, means for inhibiting the hydraulic fluid from flowing from the first chamber to the reservoir, and a hydraulically actuatable device in fluid communication with the outlet port.

In yet another aspect of the present invention, an apparatus includes a housing defining an outlet port, a movable pressure barrier disposed within the housing, the movable pressure barrier defining a chamber therein, and a return spring disposed in the chamber. The apparatus further includes an electrically actuated drive spring operatively coupled to the movable pressure barrier, the electrically actuated drive spring adapted to, when energized, urge hydraulic fluid from the chamber through the outlet port and compress the return spring and, when de-energized, allow the movable pressure barrier to move in response to a spring force stored in the compressed return spring.

In another aspect of the present invention, a method includes compressing an electrically actuated drive spring, moving a pressure barrier disposed within a chamber with energy stored in the compressed drive spring, and urging hydraulic fluid from the chamber with the moving pressure barrier.

BRIEF DESCRIPTION OF THE DRAWINGS

The invention may be understood by reference to the following description taken in conjunction with the accompanying drawings, in which like reference numerals identify like elements, and in which.

Figure 1:
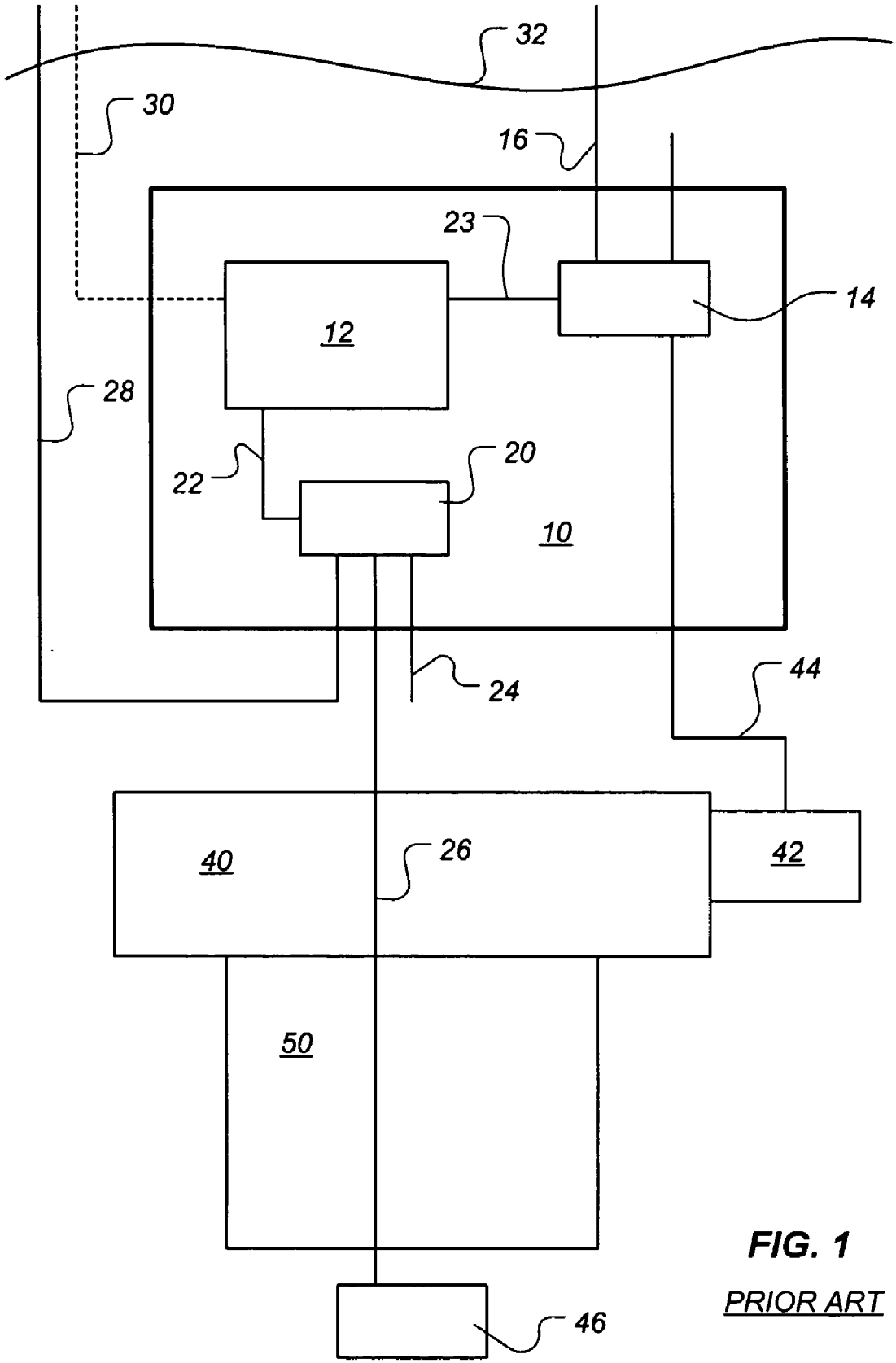
FIG. 1 PRIOR ART
FIG. 1 is a schematic representation of an existing subsea well completion system utilizing high- and low-pressure hydraulic umbilicals to the surface.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort, though complex and time-consuming, would nevertheless be a routine undertaking for those of ordinary skill in the art having the benefit of this disclosure.

The present invention will now be described with reference to the attached figures. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

In the specification, reference may be made to the direction of fluid flow between various components as the devices are depicted in the attached drawings. However, as will be recognized by those skilled in the art after a complete reading of the present application, the device and systems described herein may be positioned in any desired orientation. Thus, the reference to the direction of fluid flow should be understood to represent a relative direction of flow and not an absolute direction of flow. Similarly, the use of terms such as "above," "below," or other like terms to describe a spatial relationship between various components should be understood to describe a relative relationship between the components as the device described herein may be oriented in any desired direction.

Figure 2:
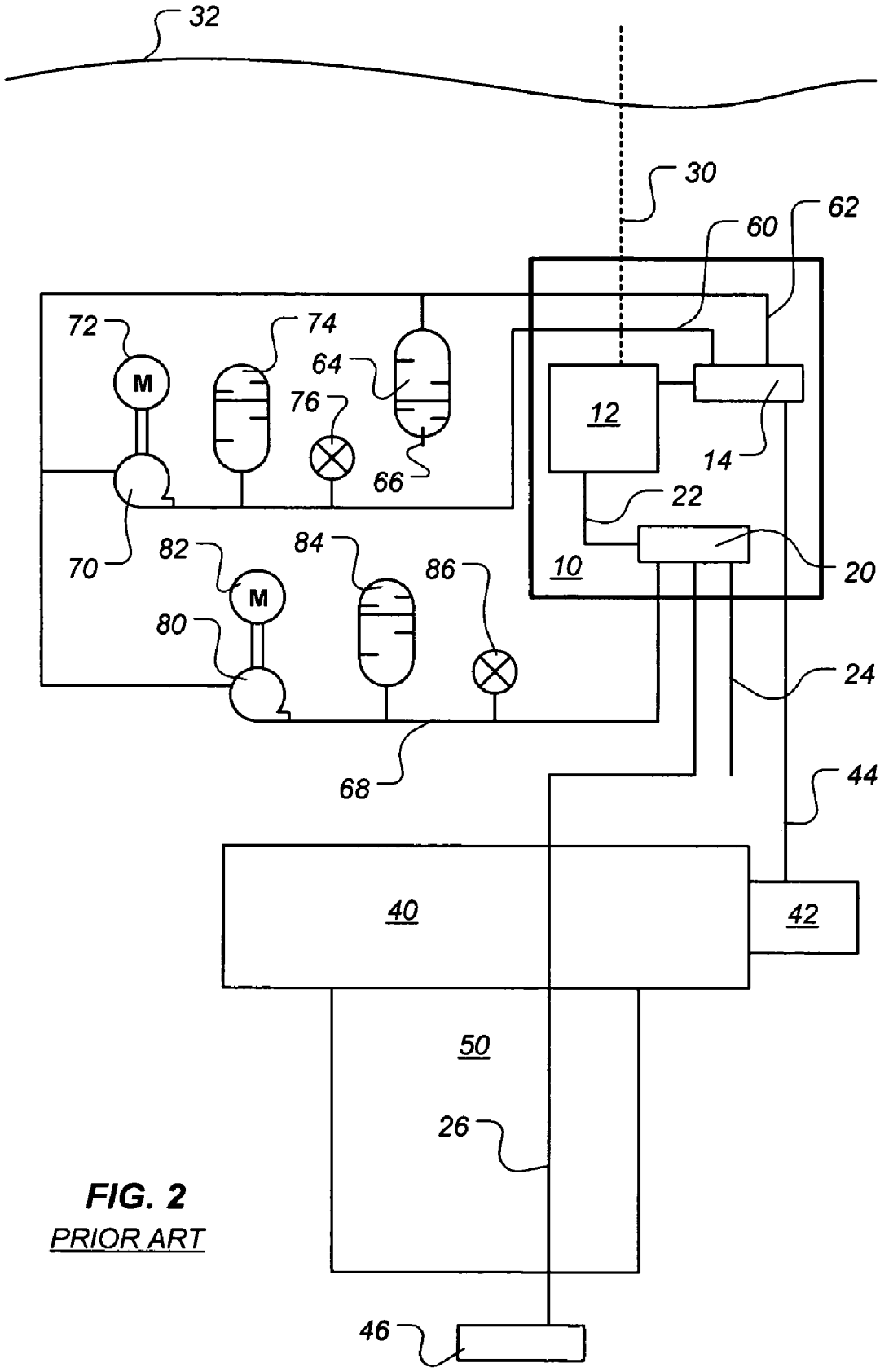
FIG. 2 PRIOR ART
FIG. 2 is a schematic representation of an existing subsea well completion system utilizing a subsea hydraulic pumping unit for high- and low-pressure hydraulic power.
Figures 3, 4:
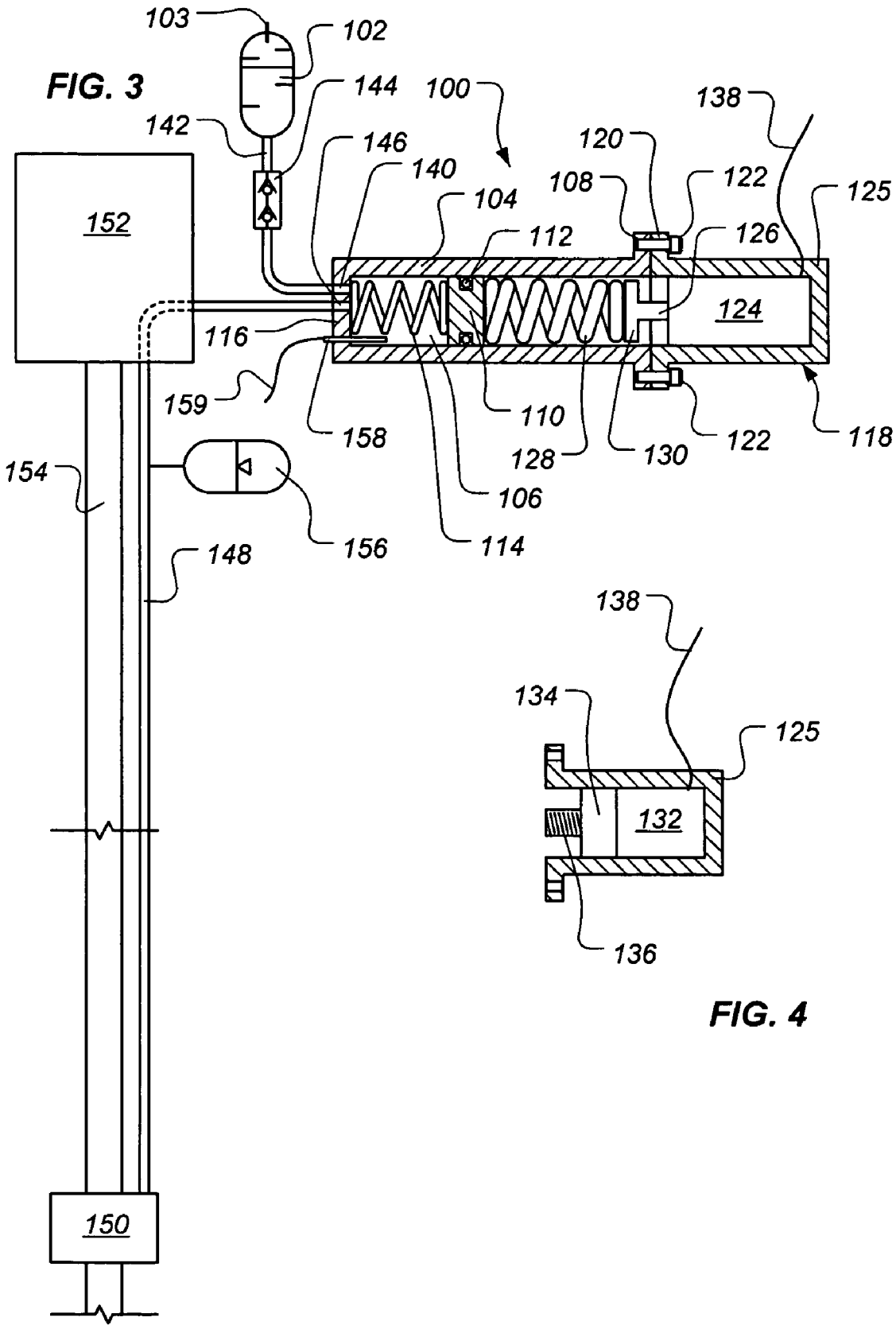
FIG. 3 is a stylized representation of a subsea well completion system including an illustrative embodiment of an electric HPU according to the present invention, which is depicted in partial cross-section, in a de-energized state.
FIG. 4 is a stylized representation of an alternative actuator assembly for the electric HPU of FIG. 3.

Referring to FIG. 3, one exemplary embodiment of the present invention includes a subsea electric-hydraulic power unit (electric HPU) 100 that replaces the motor 82, pump 80, and the solenoid valve 20 from the system of FIG. 2 and combines them into a single, compact module. In this exemplary embodiment, the source of hydraulic fluid (gas or liquid) is a reservoir 102 of hydraulic fluid that is positioned in an environment, e.g., subsea, that is at a pressure other than atmospheric pressure. Fluid in the reservoir 102 is maintained at ambient hydrostatic pressure via a vent 103. In various embodiments, the reservoir 102 is refillable by a remotely operated vehicle and/or retrievable by a remotely operated vehicle and refilled. Preferably, the reservoir 102 is provided on or near a subsea tree 152.

In one example, the electric HPU 100 comprises a housing 104 defining a piston chamber 106 and a mounting flange 108. A piston 110 is disposed within the chamber 106 and is slidably sealed to the interior of the housing 104 via a seal 112. A piston return spring 114 is disposed within the chamber 106 between the piston 110 and an end 116 of the housing 104. In the illustrated embodiment, an actuator assembly 118 is mounted to the flange 108 via a mounting flange 120 and fasteners 122. The actuator assembly 118, however, may be mounted to the housing 104 by any other suitable mounting means. In one embodiment, the actuator assembly 118 is mounted to the housing 104 such that it is replaceable by a remotely operated vehicle.

In the exemplary embodiment illustrated in FIG. 3, the actuator assembly 118 comprises a linear motor 124 disposed in a housing 125 and mechanically coupled with a stem 126. A drive spring 128 is disposed within the chamber 106 between the piston 110 and a head 130 of the stem 126. Thus, when the motor 124 is energized, the axial motion of the motor 124 is transferred to the stem 126, which, in turn, compresses the drive spring 128 and moves the piston 110 axially within the chamber 106, as will be more fully described below. In one particular exemplary embodiment, the linear motor 124 comprises a TPM50 brushless DC motor from Wittenstein Motion Control GmbH combined with a rollerscrew from SKF Motion Technologies of Bethlehem, Pa. for conversion of rotary to linear motion. The present invention is not limited to this particular configuration. Rather, the linear motor 124 may be provided as a single unit. In various embodiments, the linear motor 124 comprises a servomotor combined with a ballscrew or a rollerscrew, and, in some embodiments, combined with a planatary gearbox.

Alternatively, as shown in FIG. 4, the actuator assembly 118 may comprise a motor 132 that is connected to the stem 126 via a planetary gearbox 134 and a roller screw assembly 136. Thus, in this embodiment, when the motor 132 is energized, the rotational motion of the motor 132 is converted into axial motion of the stem 126, which, in turn, compresses the drive spring 128 and moves the piston 110 axially within the chamber 106. Also, alternatively, either the gearbox 134 for the roller screw assembly 136, or both, could be omitted or replaced by any other suitable transmission devices.

The drive spring 128 and the actuator 118 are sized to provide a force on the piston 110 such that hydraulic fluid is provided through the outlet line 148 at a pressure sufficient to open the SCSSV 150. In other words, the actuator 118 is sized to produce enough force to compress the drive spring 128. The drive spring 128 is sized to produce a spring force on the piston 110 such that hydraulic fluid is provided through the outlet line 148 at a pressure sufficient to open the SCSSV 150. The piston return spring 114 is sized to provide a force sufficient to move the piston 110 such that the drive spring 128 is against the head 130 of the stem 126 when the stem 126 is retracted. In other words, the piston 110 and the drive spring 128 need to be repositioned when the stem 126 is retracted by the actuator 118. As the piston return spring 114 is compressed when the drive spring 128 urges the piston 110, when the stem 126 is retracted, the stored energy in the piston return spring 114 moves the piston 110 such that the drive spring 128 contacts the head 130 of the stem 126. The drive spring 128 has a greater stiffness than the piston return spring 114.

While the piston return spring 114 and the drive spring 128 are illustrated in the drawings as helical springs, the present invention is not so limited. Rather, the piston return spring 114 and/or the drive spring 128 may take on other forms, such as Belleville springs. The size, spring constants, etc. of the springs 114, 128 will be implementation specific, depending at least in part upon the hydraulic pressures involved and the volume of fluid to be urged to the SCSSV 150.

The linear motor 124 or the motor 132 may be connected to a motor controller and a power source via a harness 138 or via a connector (not shown) on the housing 125. The motor controller may be deployed subsea and may communicate with a surface rig or vessel via an electrical umbilical or by acoustic signals. Alternatively, the linear motor 124 or the motor 132 could be controlled directly from the surface. The linear motor 124 or the motor 132 may be powered by a subsea deployed power source, such as batteries, or powered from the surface.

Referring again to FIG. 3, the end 116 of the housing 104 defines an inlet passage 140, which provides fluid communication between an inlet line 142 and the chamber 106. The inlet line 142 provides fluid communication between the inlet passage 140 and the reservoir 102. In the exemplary embodiment, a double check valve 144 is disposed in the inlet line 142 to inhibit the flow of fluid from the chamber 106 to the reservoir 102. In other embodiments, the double check valve 144 may be replaced with a single check valve or it may be replaced with other means for inhibiting the flow of fluid from the chamber 106 to the reservoir 102.

The end 116 of the housing 104 also defines an outlet passage 146, which provides fluid communication between the chamber 106 and an outlet line 148. The outlet line 148 provides fluid communication between the outlet passage 146 and a hydraulically actuatable device, such as a downhole SCSSV 150. In the illustrated embodiment, the outlet line 148 extends through the subsea tree 152 and adjacent a production tubing 154 to the SCSSV 150.

Under certain circumstances, the outlet line 148 could become overcharged with hydraulic fluid, such that the pressure in the outlet line 148 becomes too high. This increased pressure can be caused by downhole heating. Thus, in the exemplary embodiment of FIG. 3, a high-pressure hydraulic accumulator 156 fluidly communicates with the outlet line 148. If the pressure in the outlet line 148 becomes too high, the excess fluid and pressure can be accommodated in the accumulator 156. As illustrated, the accumulator 156 is a "gas loaded" type accumulator comprising an internal bladder separating a hydraulic fluid cavity and a gas cavity of the accumulator 156. The pressure of the gas within the gas cavity is adjusted to a desired level, e.g., a pressure somewhat above the operating or actuating pressure of the SCSSV 150.

A piston sensor 158 extends through the end 116 of the housing 104 and is connected to the motor controller via a harness 159. The piston sensor 158 may take on many different forms, e.g., a hall-effect sensor, a limit switch, a proximity switch, or the like. Irrespective of its form, the sensor 158 senses when the piston 110 reaches its compression stroke limit so that the motor controller can reverse the direction of the actuator assembly 118, as will be more fully discussed later.

The present invention may be employed to provide a pressurized fluid to a hydraulically actuable device. In one illustrative embodiment, the device disclosed herein may be employed in connection with subsea wells having a hydraulically actuatable SCSSV valve. For purposes of disclosure only, the present invention will now be described with respect to its use to actuate and control the operation of a subsea SCSSV valve. However, after a complete reading of the present application, those skilled in the art will appreciate that the present invention is not so limited and has broad applicability. Thus, the present invention should not be considered as limited to use with subsea wells or controlling SCSSV valves.

In one illustrative example, the operation of the electric HPU 100 will now be described. FIG. 3 illustrates the electric HPU 100 in a "shutdown" or "de-energized" state, in which the stem 126 is retracted and the piston return spring 114 urges the piston 110 against the drive spring 128. In this state, the SCSSV is closed. The portion of the chamber 106 between the piston 110 and the end 116 of the housing 104 contains hydraulic fluid from the reservoir 102. When it is desired to open the SCSSV 150, such as for producing from the well, the outlet line 148 and the accumulator 156 (if present) are charged to the desired pressure by stroking the piston 110, as illustrated in FIG. 5–FIG. 7.

Figure 5:
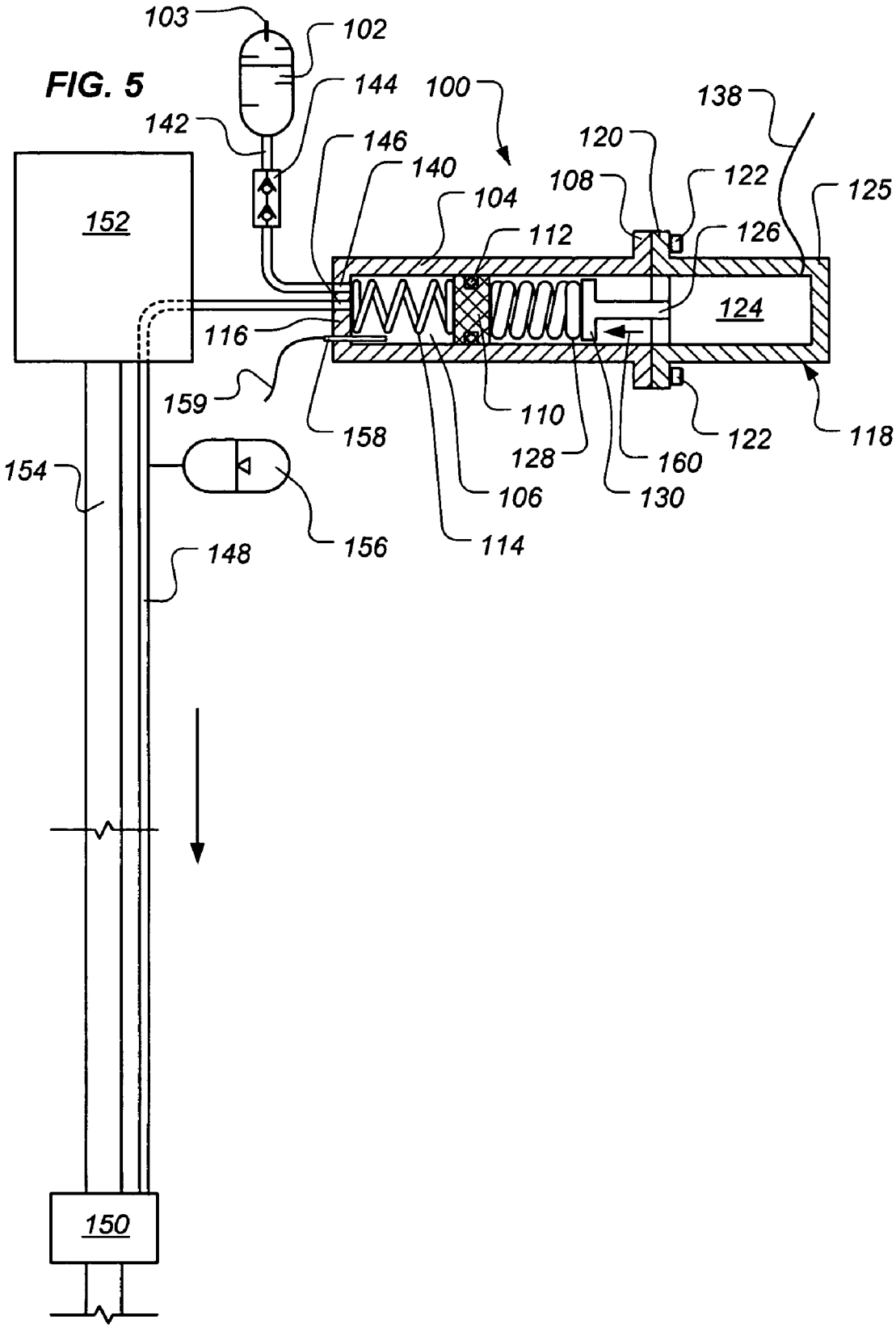
FIG. 5 is a stylized representation of the subsea well completion system of FIG. 3, in which the electric HPU has begun its pumping stroke.

As shown in FIG. 5, the linear motor 124 urges the stem 126 as indicated by an arrow 160, compressing the drive spring 128, until it reaches its full stroke. If the outlet line 148 and the accumulator 156 (if present) is fully charged, the piston 118 will move very little, if any, in the direction of the arrow 160. The stem 126 will maintain its position and the drive spring 128 will continue to apply a force to the piston 110, thus continuing to maintain hydraulic pressure in the outlet line 148. The energy stored in the drive spring 128 is sufficient to hold the SCSSV 150 open for some period of time should there be a slow leak in either of the electric HPU 100 and the SCSSV 150 or between the electric HPU 100 and the SCSSV 150. Further, hydraulic fluid from the accumulator 156, if present, will also contribute to holding the SCSSV 150 open so long as the pressure of the fluid in the accumulator 156 is at or above the operating pressure of the SCSSV 150.

Figure 6:
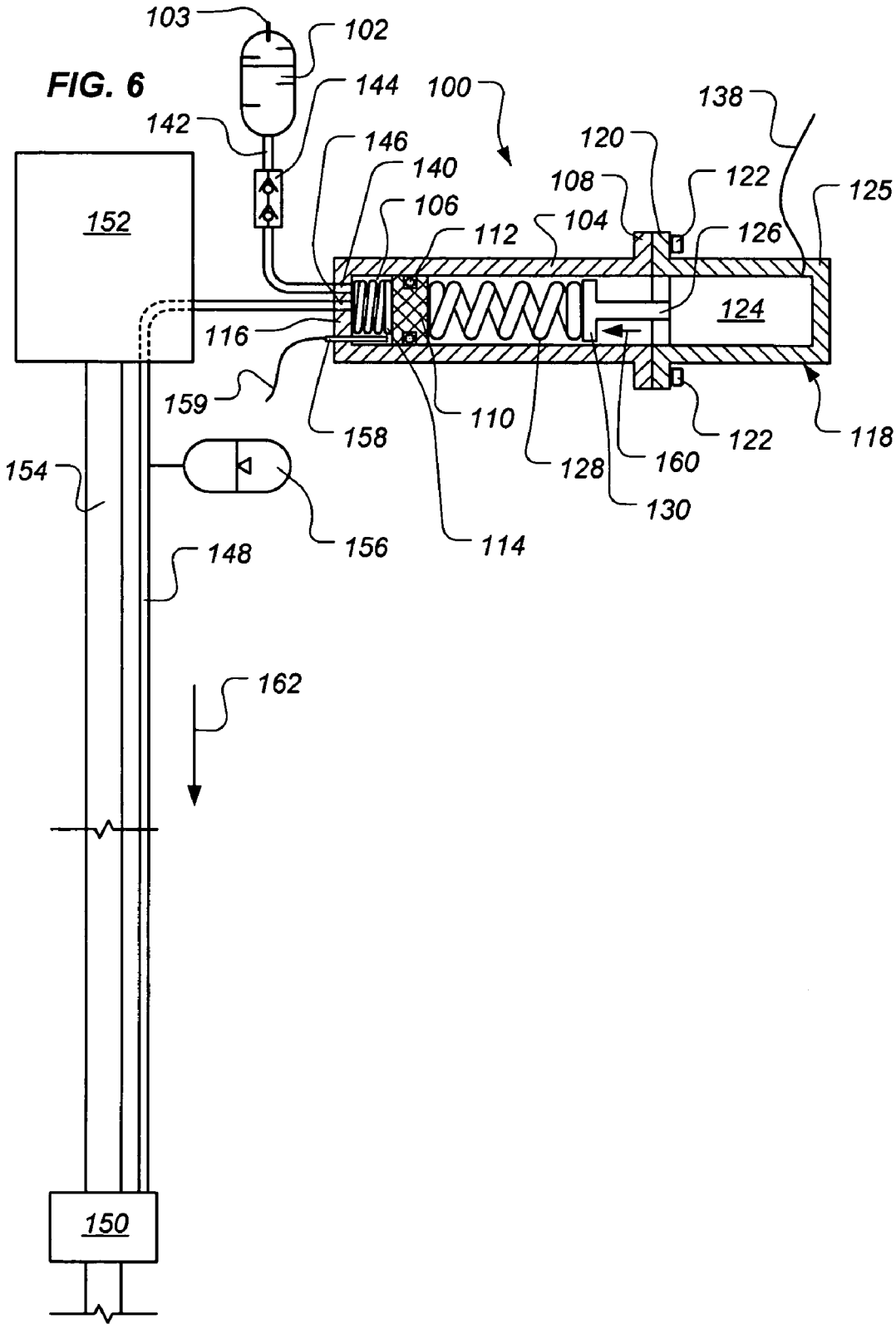
FIG. 6 is a stylized representation of the subsea well completion system of FIG. 3, in which the electric HPU has finished its pumping stroke.
Figure 7:
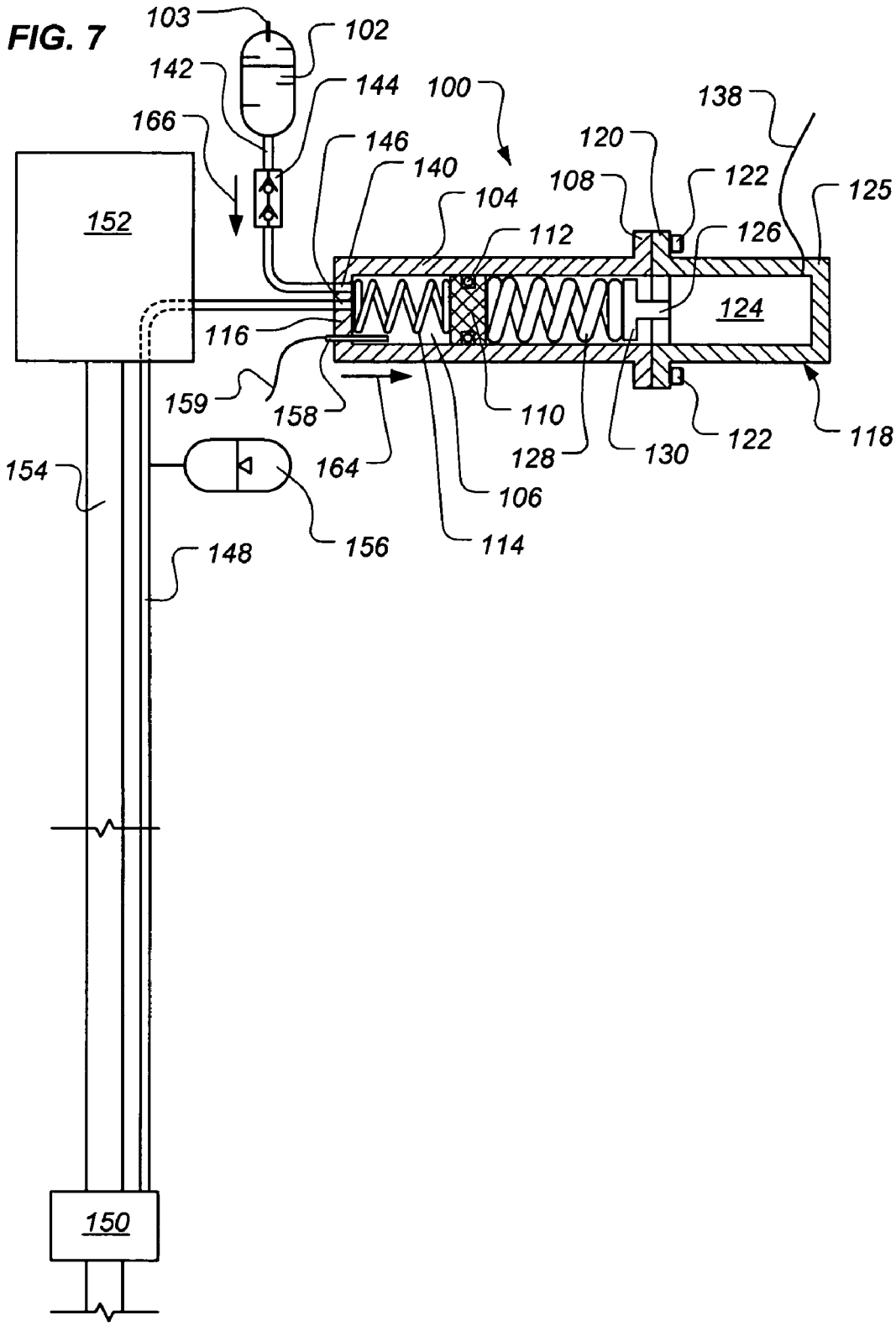
FIG. 7 is a stylized representation of the subsea well completion system of FIG. 3, in which the electric HPU has recharged with hydraulic fluid for its next pumping stroke.

If, however, the outlet line 148 and the accumulator 156 are not fully charged (e.g., at start up), the piston 110 will move in the direction of the arrow 160, as shown in FIG. 6, thus urging hydraulic fluid into the outlet line 148 to the SCSSV 150 and the accumulator 156 (if present), as indicated by an arrow 162. When the piston 110 reaches a point proximate the sensor 158, the motor controller commands the linear motor 124 to retract the stem 126, allowing the piston return spring 114 to urge the piston 110 in a direction indicated by an arrow 164, as shown in FIG. 7. When this happens, hydraulic fluid is drawn from the reservoir 102, through the check valve 144 and the inlet line 140, as indicated by an arrow 166, and into the portion of the chamber 106 between the piston 110 and the end 116 of the housing 104. At this point, the motor controller will command the linear motor 124 to extend the stem 126, as shown in FIG. 5, and the cycle can be repeated.

The present invention is directed to an electric-hydraulic power unit. In one illustrative embodiment, the apparatus includes a housing defining a chamber and a movable pressure barrier, disposed in the chamber, separating the chamber into first and second portions. The apparatus further includes a drive spring disposed in the second portion of the chamber for urging the movable pressure barrier in a pumping direction when in a compressed state and a return spring disposed in the first portion of the chamber for urging the movable pressure barrier in a recharging direction when the drive spring is in an uncompressed state.

In another illustrative embodiment, an apparatus includes a housing defining a chamber therein and defining an inlet port and an outlet port and a movable pressure barrier, disposed in the chamber, separating the chamber into first and second portions, the inlet port and the outlet port being in fluid communication with the first portion of the chamber. The apparatus further includes a drive spring disposed in the second portion of the chamber for urging the movable pressure barrier in a pumping direction when in a compressed state, electric means for compressing the drive spring, and a return spring disposed in the first portion of the chamber for urging the movable pressure barrier in a recharging direction when the drive spring is in an uncompressed state. The apparatus also includes a reservoir containing hydraulic fluid in fluid communication with the inlet port, means for inhibiting the hydraulic fluid from flowing from the first chamber to the reservoir, and a hydraulically actuatable device in fluid communication with the outlet port.

In yet another illustrative embodiment, an apparatus includes a housing defining an outlet port, a movable pressure barrier disposed within the housing, the movable pressure barrier defining a chamber therein, and a return spring disposed in the chamber. The apparatus further includes an electrically actuated drive spring operatively coupled to the movable pressure barrier, the electrically actuated drive spring adapted to, when energized, urge hydraulic fluid from the chamber through the outlet port and compress the return spring and, when de-energized, allow the movable pressure barrier to move in response to a spring force stored in the compressed return spring.

In an illustrative embodiment of a method for operating an HPU, the method includes compressing an electrically actuated drive spring, moving a pressure barrier disposed within a chamber with energy stored in the compressed drive spring, and urging hydraulic fluid from the chamber with the moving pressure barrier.

This concludes the detailed description. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. An apparatus, comprising:

a housing defining a chamber;

a movable pressure barrier, disposed in the chamber, separating the chamber into first and second portions;

a drive spring disposed in the second portion of the chamber for urging the movable pressure barrier in a pumping direction when in a compressed state;

a return spring disposed in the first portion of the chamber for urging the movable pressure barrier in a recharging direction when the drive spring is in an uncompressed state; and an electrically powered actuator that is adapted to, when actuated, compress said drive spring.

2. An apparatus, according to claim 1, wherein the movable pressure barrier comprises a piston.

3. An apparatus, according to claim 2, wherein the piston comprises a seal for slidably sealing the piston to an interior surface of the housing.

4. An apparatus, according to claim 1, wherein said drive spring engages a first side of said movable pressure barrier and said return spring engages a second side of said movable pressure barrier opposite said first side.

5. An apparatus, according to claim 1, wherein said electrically powered actuator comprises an electric motor operatively coupled to the drive spring.

6. An apparatus, according to claim 5, wherein the electric motor is operatively coupled to the drive spring via a stem.

7. An apparatus, according to claim 5, wherein the electric motor comprises an electric linear motor.

8. An apparatus, according to claim 5, further comprising:

a planetary gear box coupled with the electric motor; and a roller screw assembly coupled with the planetary gear box and operatively coupled with the drive spring.

9. An apparatus, according to claim 1, further comprising a sensor extending into the first portion of the chamber for detecting a presence of the movable pressure barrier.

10. An apparatus, according to claim 9, wherein the sensor comprises one of a hall effect sensor, a limit switch, and a proximity sensor.

11. An apparatus, according to claim 1, wherein the drive spring has a greater stiffness than the return spring.

12. An apparatus, comprising:

a housing defining a chamber therein and defining an inlet port and an outlet port;

a movable pressure barrier, disposed in the chamber, separating the chamber into first and second portions, the inlet port and the outlet port being in fluid communication with the first portion of the chamber;

a drive spring disposed in the second portion of the chamber for urging the movable pressure barrier in a pumping direction when in a compressed state;

an electrically powered actuator that is adapted to, when actuated, compress the drive spring;

a return spring disposed in the first portion of the chamber for urging the movable pressure barrier in a recharging direction when the drive spring is in an uncompressed state;

a reservoir containing hydraulic fluid in fluid communication with the inlet port;

means for inhibiting the hydraulic fluid from flowing from the first chamber to the reservoir; and a hydraulically actuatable device in fluid communication with the outlet port.

13. An apparatus, according to claim 12, wherein the means for inhibiting comprises one of a check valve and a double check valve.

14. An apparatus, according to claim 12, wherein the reservoir comprises a vent for maintaining ambient hydrostatic pressure within the reservoir.

15. An apparatus, according to claim 12, wherein the hydraulically actuatable device comprises a downhole hydraulically actuatable device.

16. An apparatus, according to claim 15, wherein the downhole hydraulically actuatable device comprises a subsea safety valve.

17. An apparatus, according to claim 15, wherein the electrically powered actuator comprises an electric motor operatively coupled to the drive spring.

18. An apparatus, comprising:

a housing defining an outlet port;

a movable pressure barrier disposed within the housing, the movable pressure barrier defining a chamber therein;

a return spring disposed in the chamber;

a drive spring operatively coupled to the movable pressure barrier;

an electrically powered actuator that is adapted to, when actuated, energize said drive spring, wherein said drive spring is adapted to:

when energized, urge hydraulic fluid from the chamber through the outlet port and compress the return spring; and when de-energized, allow the movable pressure barrier to move in response to a spring force stored in the compressed return spring.

19. An apparatus, according to claim 18, the housing further defining an inlet port through which hydraulic fluid enters the chamber when the movable pressure barrier moves in response to the spring force stored in the compressed return spring.

20. An apparatus, according to claim 19, further comprising a check valve and a vented reservoir containing hydraulic fluid in fluid communication with the inlet port via the check valve.

21. An apparatus, according to claim 18, further comprising a hydraulically actuatable device in fluid communication with the outlet port.

22. An apparatus, according to claim 21, wherein the hydraulically actuatable device comprises a subsea safety valve.

23. An apparatus, according to claim 18, further comprising an accumulator in fluid communication with the outlet port.

24. An apparatus, according to claim 18, wherein said drive spring engages a first side of said movable pressure barrier and said return spring engages a second side of said movable pressure baffler opposite said first side.

25. A method, comprising:

activating an electrically powered actuator to compress a drive spring that is operatively coupled to a movable pressure barrier;

moving said pressure barrier disposed within a chamber in a first direction with energy stored in the compressed drive spring; and urging hydraulic fluid from the chamber with the moving of said pressure barrier in said first direction.

26. A method, according to claim 25, further comprising:

compressing a return spring that is operatively coupled to said movable pressure barrier with the energy stored in the compressed drive spring;

moving the pressure barrier in a second direction opposite said first direction with the energy stored in the compressed return spring when the compression of said drive spring is reduced; and recharging the chamber with hydraulic fluid as a result of moving the pressure barrier in said second direction with the energy stored in the compressed return spring.

27. A method, according to claim 25, wherein urging hydraulic fluid further comprises urging hydraulic fluid to a hydraulically actuatable device.

28. A method, according to claim 27, wherein urging hydraulic fluid to the hydraulically actuatable device further comprises urging hydraulic fluid to a subsea safety valve.

29. A method, according to claim 25, wherein urging hydraulic fluid further comprises charging an accumulator with hydraulic fluid.

* * * * *

UNITED STATES PATENT AND TRADEMARK OFFICE

CERTIFICATE OF CORRECTION

PATENT NO. : 7,156,183 B2
APPLICATION NO. : 10/990736
DATED : January 2, 2007
INVENTOR(S) : Michael R. Williams It is certified that error appears in the above-identified patent and that said Letters Patent is hereby corrected as shown below:

Col. 10, line 27 (claim 24, line 4), change “baffler” to -- barrier --.

Signed and Sealed this

Sixth Day of March, 2007

JON W. DUDAS
*Director of the United States Patent and Trademark Office*